US006295699B1

(12) United States Patent
Temburg

(10) Patent No.: US 6,295,699 B1
(45) Date of Patent: Oct. 2, 2001

(54) SLIVER ORIENTING DEVICE IN A DRAW FRAME

(75) Inventor: Josef Temburg, Jüchen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/614,151

(22) Filed: Jul. 11, 2000

Related U.S. Application Data

(63) Continuation of application No. 09/514,178, filed on Feb. 28, 2000.

(30) Foreign Application Priority Data

Feb. 26, 1999 (DE) ..... 199 08 371

(51) Int. Cl.[7] ..... D01H 5/32
(52) U.S. Cl. ..... 19/239; 19/157
(58) Field of Search ..... 19/236–240, 242, 19/258–260, 266, 270, 271, 277, 281, 150, 157; 57/315, 281; 492/10, 16; 226/188, 190

(56) References Cited

U.S. PATENT DOCUMENTS 576,736 * 2/1897 Threlfall et al. ..... 19/236
2,608,725 * 9/1952 Strew ..... 19/157
3,243,853 * 4/1966 Whitehurst ..... 19/240
5,487,208 * 1/1996 Hauner ..... 19/157
5,621,948 * 4/1997 Hartung ..... 19/150
5,630,251 * 5/1997 Leifeld ..... 19/239
5,852,844 * 12/1998 Leifeld ..... 19/159 A
6,081,972 * 7/2000 Strobel et al. ..... 19/239
6,088,882 * 7/2000 Leifeld ..... 19/239
6,119,312 * 9/2000 Leifeld ..... 19/150

FOREIGN PATENT DOCUMENTS 41 16 299 11/1991 (DE) .
197 49831 4/1999 (DE) .
0 308 215 3/1989 (EP) .
0 367 042 5/1990 (EP) .
0 367 211 5/1990 (EP) .
0 467 117 1/1992 (EP) .

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A draw frame for drawing a plurality of simultaneously running inputted slivers and for combining the drawn silvers into a single outputted sliver includes a draw unit having an inlet, an outlet and a roll assembly between the inlet and the outlet for drawing the inputted slivers; a creel for accommodating a sliver-containing coiler cans for advancing simultaneously a plurality of slivers to the draw unit; a sliver guide and a sliver trumpet arranged downstream of the draw unit outlet, as viewed in a direction of sliver run, for combining the plurality of drawn slivers into the output sliver; and a guiding assembly for orienting the running inputted slivers to run linearly and parallel to one another, as viewed in a vertical direction, from the creel at least to the outlet of the draw unit.

15 Claims, 8 Drawing Sheets

SLIVER ORIENTING DEVICE IN A DRAW FRAME

CROSS REFERENCE TO RELATED APPLICATIONS

This application is a continuation of pending application Ser. No. 09/514,178 filed Feb. 28, 2000.

This application claims the priority of German Application No. 199 08 371.1, filed Feb. 26, 1999, which is incorporated herein by reference.

BACKGROUND OF THE INVENTION

This invention relates to a draw frame for processing a fiber bundle composed of a plurality of slivers. The draw frame includes a creel, a measuring assembly and a draw unit. The slivers are introduced from the creel to the draw unit, then run therethrough while a measuring assembly disposed between the creel and the draw unit senses the thickness of the slivers. The measuring signals of the thickness sensor are used for regulating the draw frame. A sliver guide and a sliver trumpet are positioned downstream of the draw unit as viewed in the direction of sliver run.

The coiler cans containing the sliver to be introduced into the draw frame are conventionally arranged along one side or both sides of the creel. Above each coiler can a withdrawing device is arranged by means of which the sliver is pulled from the respective coiler can and is deflected in the direction of the draw frame. The slivers are advanced above the creel and are subsequently combined into a fiber bundle. The fiber bundle which is thus composed of a plurality of slivers is admitted into the draw unit after it passes a sensor. In the draw unit the slivers are stretched and doubled and are subsequently gathered in a sliver guide arranged at the outlet of the draw unit and then introduced into a sliver trumpet and combined into a single, stretched sliver for subsequent processing.

As described in German Offenlegungsschrift (application published without examination) 42 12 720, a storage belt is provided on which piles of slivers are positioned at several storage emplacements. Above the storage belt a conveyor belt is positioned which advances the slivers to the draw frame. Above each emplacement a pressing roll cooperates with the conveyor belt. The pressing rolls are preceded by deflecting guides which orient the sliver, taken from the emplacement, to the wedge-shaped gap provided between the pressing roll and the conveyor belt. The sliver removing device is essentially formed by the pressing rollers and the deflecting guides. Immediately upstream of the draw frame a driven deflecting roller cooperates with the conveyor belt. Further, immediately upstream of the draw frame a funnel-shaped densifier is provided which gathers the incoming slivers into a densified sliver bundle. An intake roll pair of the draw frame subsequently advances the sliver bundle to a roll pair which, as a measuring member, monitors the mass of the throughgoing sliver bundle by performing a mechanical mass measurement (thickness measurement). This is effected by passing the sufficiently densified sliver bundle through an intake funnel under a highly loaded floating pressure roll whose excursions are detected. Such excursions which represent the mass (thickness) variations of the sliver bundle, are converted into electric signals which, in turn, are used to regulate the draw unit. The drawn sliver discharged from the draw frame is deposited into a coiler can.

It is a disadvantage of the above-discussed conventional system that the fiber material is caused to change its running direction repeatedly from the time it is positioned on the conveyor belt until it is pulled off by the output rolls situated downstream of the draw unit of the draw frame. Each change of direction requires suitable structural elements and each such change involves frictional losses.

It is a further disadvantage that the configuration of the fiber material changes several times: in one phase it is advanced as separately running slivers and in another as a compressed sliver bundle which is then separated into individual slivers. These eventually emerge as the final, single, drawn output sliver. Thus, in the region of the draw unit the slivers are pressed between a pressure roll and a lower roll into a sliver bundle which, as known, subsequently again spreads into individual slivers and runs in this condition through the draw unit. At the output of the draw unit a sliver guide laterally gathers the individual slivers and combines them into the final output sliver. This procedure imparts to the slivers undesired structural changes, in addition to the earlier-noted directional changes.

It is yet another disadvantage of the conventional apparatus that it is of complex and expensive construction. Also, the multiple directional and shape changes adversely affect the output rate.

SUMMARY OF THE INVENTION

It is an object of the invention to provide an improved apparatus of the above-outlined type from which the discussed disadvantages are eliminated and which, in particular, operates without affecting the fiber material in an undesired manner, which is structurally simple and makes possible a high output rate.

This object and others to become apparent as the specification progresses, are accomplished by the invention, according to which, briefly stated, the draw frame for drawing a plurality of simultaneously running inputted slivers and for combining the drawn silvers into a single outputted sliver includes a draw unit having an inlet, an outlet and a roll assembly between the inlet and the outlet for drawing the inputted slivers; a creel for accommodating a sliver-containing coiler cans for advancing simultaneously a plurality of slivers to the draw unit; a sliver guide and a sliver trumpet arranged downstream of the draw unit outlet, as viewed in a direction of sliver run, for combining the plurality of drawn slivers into the output sliver; and a guiding assembly for orienting the running inputted slivers to run linearly and parallel to one another, as viewed in a vertical direction, from the creel at least to the outlet of the draw unit.

By virtue of the fact that from the creel at least up to and including the outlet end of the draw unit the fiber material is always in the form of individual slivers which preserve their direction of run, undesired structural changes, particularly frictional losses are avoided. The slivers run through the creel and the draw unit parallel to one another and practically do not change their direction whereby a significantly higher output rate may be obtained. In particular, a plurality of machine components causing the directional changes and the like are eliminated whereby significant simplifications are achieved as far as structure and installation are concerned. The essentially linear, parallel run of the slivers combined with the preservation of the sliver configuration makes possible to achieve the structural and functional advantages of the measures according to the invention.

The invention has the following additional advantageous features:

In the region of each coiler can a deflecting element is mounted on the creel and the deflecting element orients the slivers into a parallel arrangement.

The deflecting elements are offset as viewed parallel to the machine width.

The deflecting elements are driven rollers or the like.

The measuring assembly has, parallel to the machine width, a plurality of sensor elements for detecting thickness variations in each sliver, and the sensor elements are arranged parallel to one another.

The individual sensor elements mechanically detect thickness variations along the width at several locations and the sensor elements operate with sensor fingers.

At least one transducer is provided for converting the mechanical excursions into electric signals.

The slivers run essentially linearly and parallel to one another up to the sliver guide.

The slivers are in lateral contact with one another in the region of the creel.

The width of the sliver bundle on the creel, in the region of the measuring element and in the draw unit is essentially the same.

The slivers run in the same direction.

The slivers run in part above the creel beam.

The deflecting element is an annular eyelet structure which is rotatable in the radial direction.

DESCRIPTION OF THE PREFERRED EMBODIMENTS

Figure 1A:
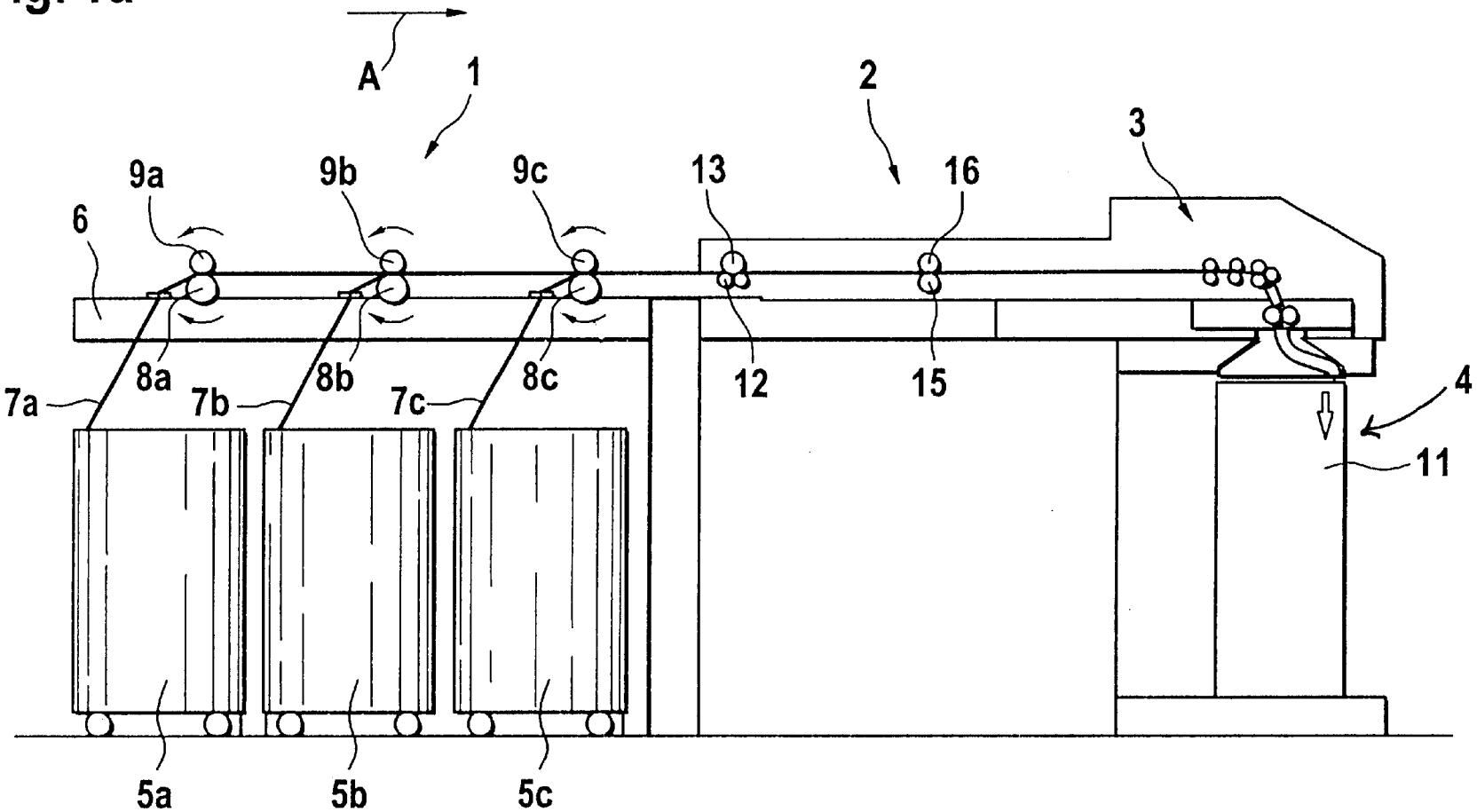
FIG. 1*a* is a schematic side elevational view of a draw frame incorporating the invention.
Figure 1B:
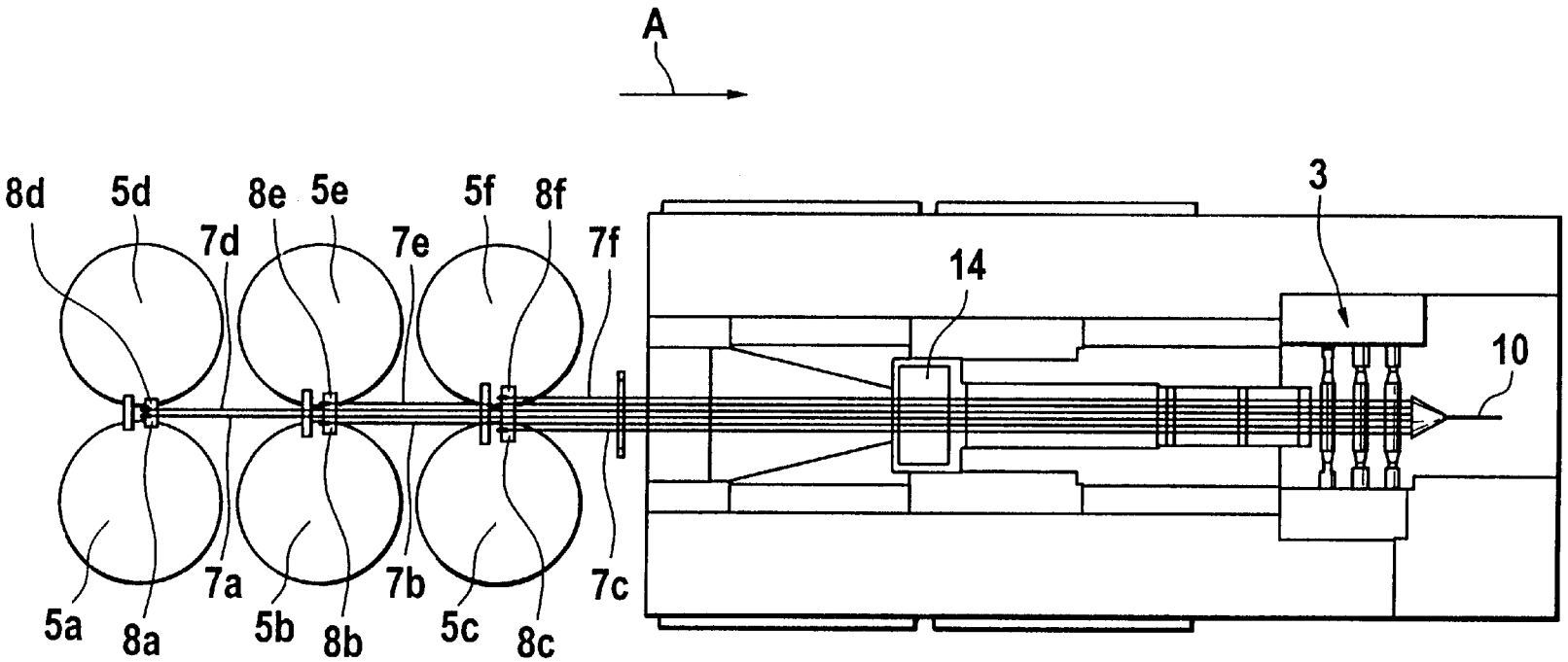
FIG. 1*b* is a top plan view of the construction shown in FIG. 1*a*.

FIGS. 1*a* and 1*b* illustrate the intake region 1, the measuring region 2, the draw unit 3 and the sliver depositing system 4 of a draw frame which may be, for example, an HSR model manufactured by Trtitzschler GmbH & Co. KG, Monchengladbach, Germany. In the intake region 1 six round coiler cans 5*a*–5*f* are shown which are positioned in two rows underneath a creel 6. From the coiler cans 5*a*–5*f* respective slivers 7*a*–7*f* are withdrawn by a sliver intake device including six respective roll pairs mounted on the creel 6 and formed of supply rolls (lower rolls) 8*a*–8*f* and upper rollers (pressure rollers), of which only rollers 9*a*–9*c* are visible in FIG. 1*a*. The supply rolls 8*a*–8*f* are driven, while the respective upper rollers are idlers and frictionally driven by the respective lower rolls. The slivers 7*a*–7*f* which are crushed by the respective roll pairs, are forwarded to the draw frame on the creel 6. After passing the draw unit 3, the drawn single sliver 10 is advanced to a rotary head of a sliver coiler and is deposited in loops in an output can 11. The creel 6 extends up to the draw frame in the region of the entire sliver intake device. The slivers pulled from the coiler cans tend to balloon above the coiler cans particularly in case of high withdrawing speeds and are quieted by the roll pairs on the creel 6. Downstream of the creel 6, at the inlet of the draw frame, a driven intake roll assembly 12, 13 is arranged.

During operation, either all six coiler cans are active and thus six slivers are withdrawn simultaneously or at any time only the three coiler cans of one row are active, while the three coiler cans of the other row are being replaced. The supply rolls 8*a*–8*f* are arranged in coaxial pairs and have the same diameter, for example, 100 mm. The rpm's of the successive supply roll pairs which decrease in the running direction of the slivers, are determined by a control and regulating device 38 (shown in FIG. 5) so that the circumferential speed of the supply roll pairs 8*a*, 8*d*; 8*b*, 8*e*; and 8*c*, 8*f* decreases in the direction of sliver advance. The circumferential velocities of the supply rolls may be thus individually set so that the intake tension of each sliver may be adjusted in the desired manner. The drive of the supply rolls 8*a*–8*f* may be a gearing with suitable down-stepping devices. The successive roll pairs (formed by a supply roll and a pressure roller) are arranged on the creel 6 in such a manner that the length of the slivers 7*a*–7*f* in the intake region 1 either decreases (FIG. 1*b*) or increases (FIG. 2) as viewed from the inside outwardly. The slivers 7*a*–7*f*, after they have left the region of the creel 6, run through a measuring assembly 14 up to the outlet of the draw unit 3 substantially linearly and parallel to one another.

Figure 2:
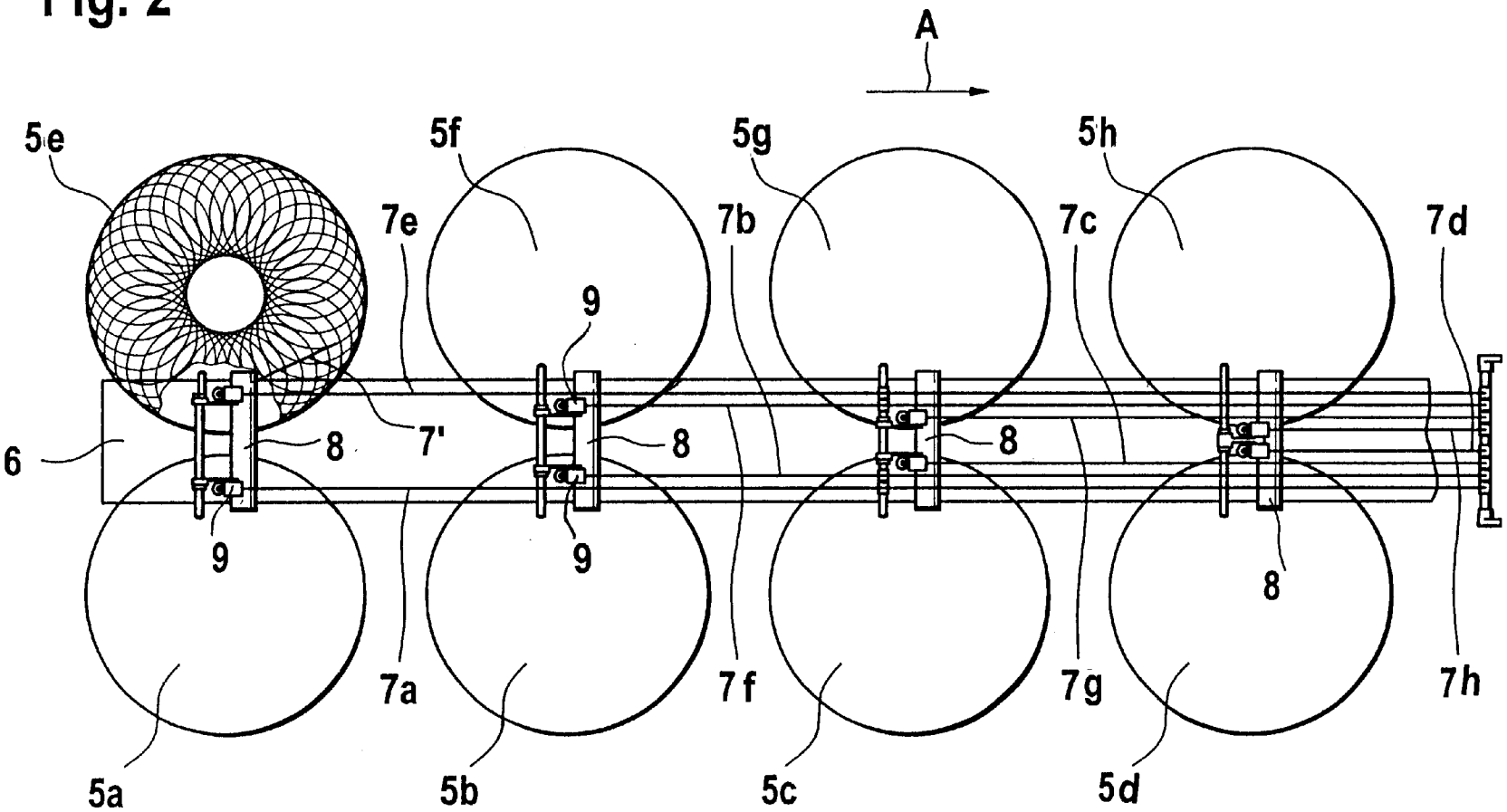
FIG. 2 is a schematic top plan view of a creel showing coiler cans and linearly running slivers.

In FIG. 2 a total of eight slivers 7*a*–7*h* may be supplied from eight respective coiler cans 5*a*–5*h*. It is further seen that in the construction of FIG. 2, instead of separate axially aligned supply rolls 8*a*, 8*d*, 8*b*, 8*e*, etc. (as shown in FIG. 1*b*) single supply rolls 8 are provided. With each supply roll 8 two upper rollers 9 cooperate; the two upper rollers 9 associated with one and the same supply roll 8 serve adjoining coiler cans situated on opposite sides of the creel 6.

Figure 2A:
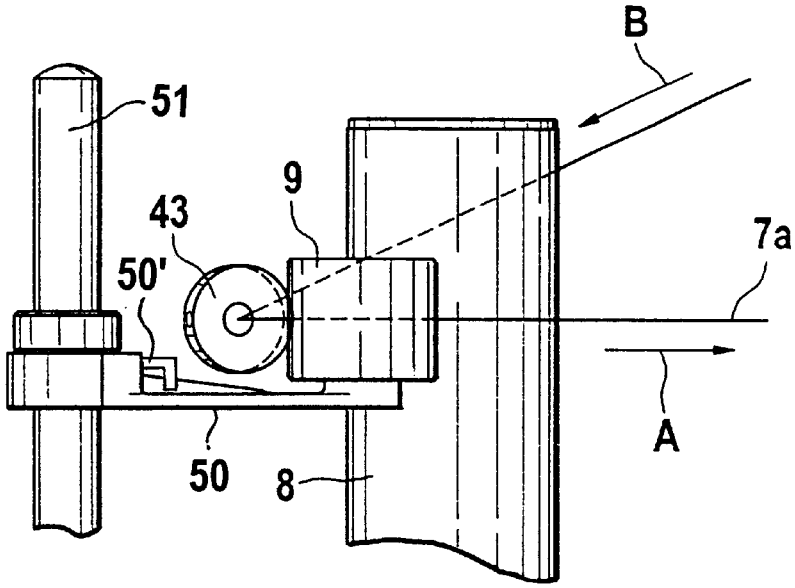
FIG. 2*a* is a fragmentary top plan view illustrating a sliver deflected by an eyelet and running between a lower, supply roll and an upper, pressure roller.

FIG. 2*a* shows further details of the sliver crushing assembly 8, 9. From the coiler can 5*a* (not shown) the sliver 7*a* is withdrawn, passed through the eyelet 43, deflected thereby and advanced into the nip defined between the supply roll 8 and the upper roller 9. As the sliver 7*a* emerges from the roll pair 8, 9 it proceeds horizontally as also illustrated in FIG. 1*a*. The roller 9 is carried at the end of a pivot lever 50 which is rotatably supported on a shaft 51 and may be pressed against the supply roll 8 by a spring 50' engaging the lever 50.

Figure 2B:
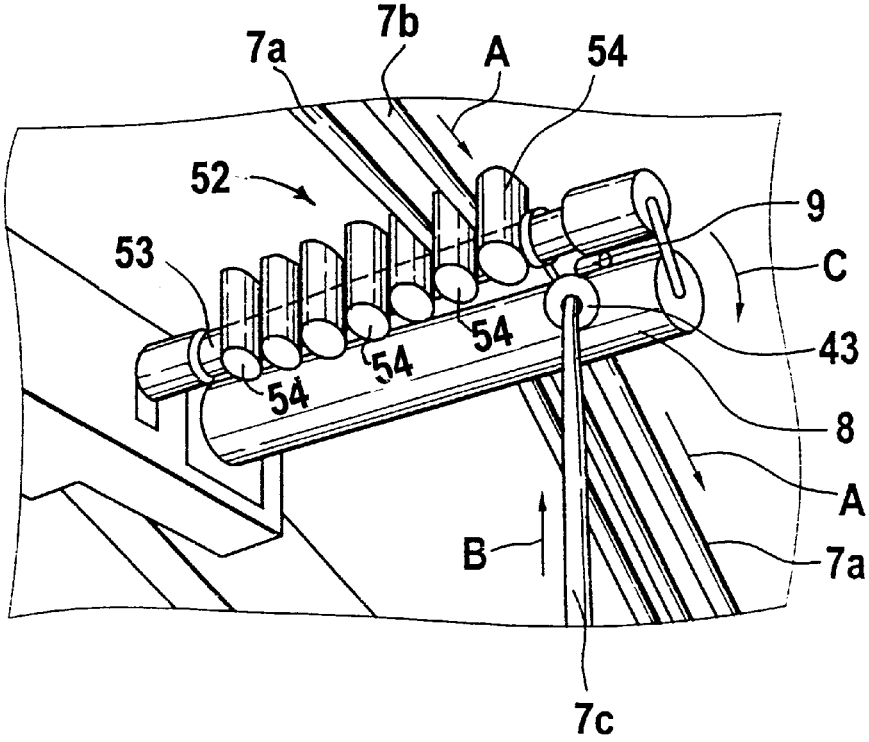
FIG. 2*b* is a perspective view showing details of sliver guiding members.

FIG. 2*b* illustrates further details of the sliver guide mechanism. In the example shown in this Figure, the arrangement according to FIG. 1*b* is illustrated where a sliver 7*c* first runs vertically upwardly in the direction of the arrow B from its coiler can 5*c* (not shown). The slivers 7*a* and 7*b* have been withdrawn previously from their respective coiler cans Sa and 5*b* and thus run above and spaced from the roll assembly 8, 9 associated with the sliver 7*c* and run between a guide assembly 52 formed of a supporting roll 53 as well as cooperating guide rolls 54 which rotate about a vertical axis.

Figure 3A:
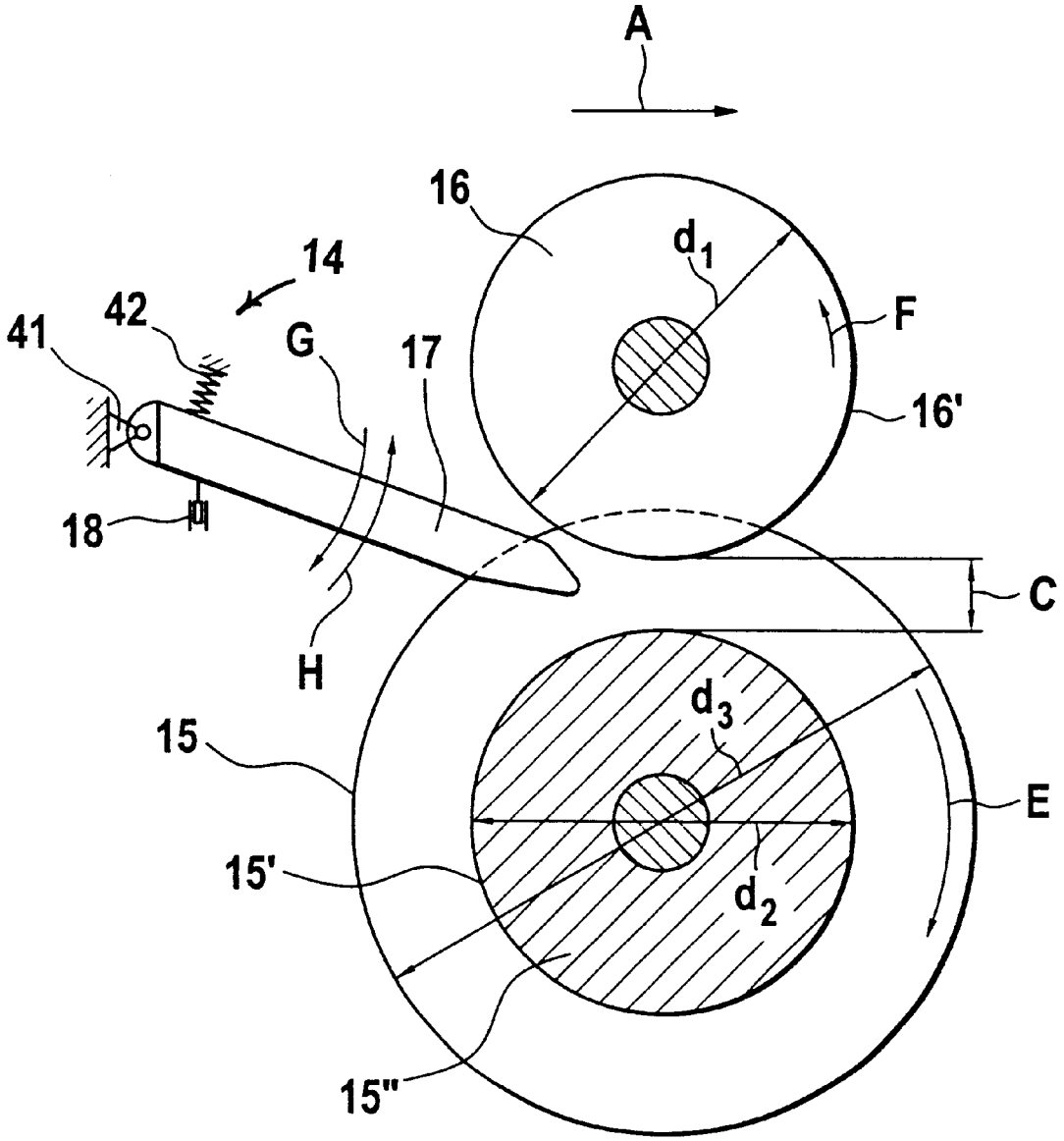
FIG. 3*a* is a sectional side elevational view of a measuring assembly formed by groove and tongue rollers and a mechanical sensor element.
Figure 3B:
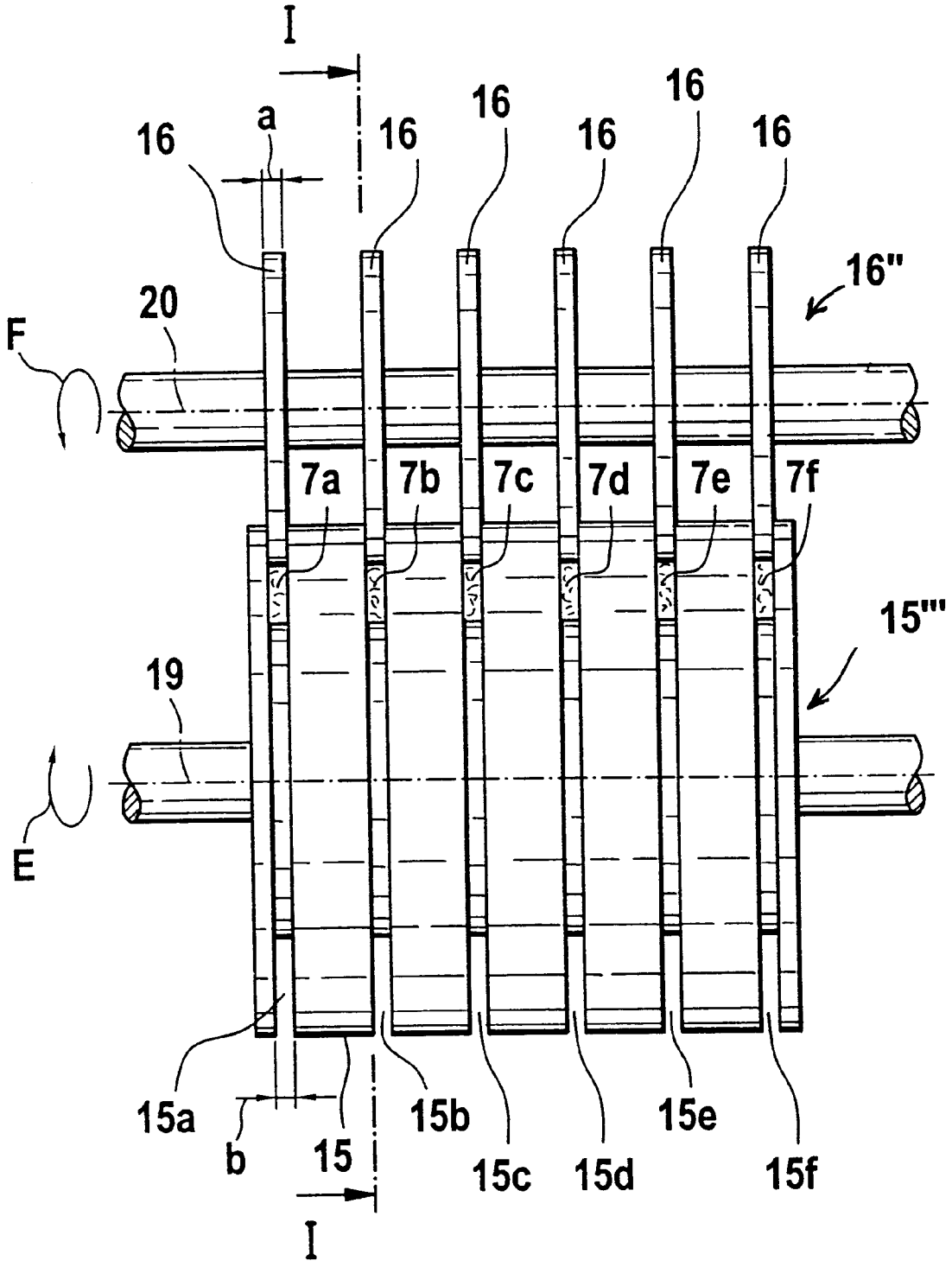
FIG. 3*b* is a front elevational view of the construction shown in FIG. 3*a*.

Turning to FIGS. 3*a* and 3*b*, a pair of densifying, cooperating rollers 15 and 16 are shown. This roller pair is, as shown in FIG. 1*a*, arranged in the measuring region 2, downstream of the creel 6 and upstream of the draw unit 3. The roller 15 is a groove roller whereas the roller 16 is a tongue roller which rotate in the direction of arrows E and F, respectively. The two rollers together define a closed space of rectangular cross section through which a sliver passes. During operation, the axes of the rollers 15 and 16 are stationary relative to one another; their axial distance is adjustable. As viewed in the direction of sliver advance, immediately upstream of the roller pair 15, 16 a measuring assembly 14 is arranged which has an elongated sensor finger 17 and a measuring value transducer 18 which may be, for example, an inductive displacement sensor. The sensor finger 17 which is movable in the direction of the arrows G and H is attached to a rotatable shaft supported in a bearing 41. The other end of the sensor finger 17 extends into the groove of the groove roller 15 and is situated in the vicinity of the nip defined between the rollers 15, 16. The sliver is passed in the direction A through the closed space between the rollers 15 and 16. The tongue roller 16 has a cylindrical edge surface 16' which defines a nip, having a clearance c, with the cylindrical groove bottom 15' of the groove roller 15.

During operation the finger 17, biased by the spring 42, presses the sliver against the groove bottom 15' whereby the sliver is scanned and compressed. The side walls of the groove of the groove roller 15 laterally support the sliver and thus prevent a spreading of the sliver to either side.

FIG. 3*b* shows the groove and tongue rollers of FIG. 3*a* in a ganged arrangement. Thus, in the construction according to FIG. 3*b*, a tongue roller assembly 16" is mounted on a rotary shaft 20 whereas a groove roller assembly 15'" has a plurality of grooves 15*a*–15*f* and is mounted on a rotary shaft 19. In FIG. 3*a*, the diameter $d_1$ of the tongue roller 16 and the diameter $d_2$ of the hub part 15" of the groove roller 15 are identical to one another, whereas the diameter $d_3$ of the groove roller 15 (including thus the groove walls) is greater than the diameter $d_2$. The width of the sensor finger 17 essentially corresponds to the axial distances a or b of FIG. 3*b*, designating the thickness of the tongue rolls and the width of the grooves of the groove rollers. A respective sensor finger (not shown in FIG. 3*b*) which cooperates with the groove bottom of each tongue-and-groove roller pair, compresses the sliver only to the extent that is necessary for sensing the thickness and/or irregularities in the running sliver. In the nip formed between a tongue roller and a cooperating groove roller the compression is effected only to such an extent that is necessary for the conveyance of the sliver. Thus, the arrangement illustrated in FIGS. 3*a* and 3*b* provides for an individual thickness or uniformity sensing of the individual slivers. The excursions of the sensor fingers are added by the electronic system shown in FIG. 5. The construction illustrated in FIGS. 3*a*, 3*b* provides for a substantially parallel guidance (as viewed from the top) of the slivers 7*a*–7*f* from prior to their entry into the draw unit, through the draw unit and up to the sliver guide at the draw unit outlet. Thus, convergences, divergences or deflections to which conventionally the slivers have been exposed are avoided.

Figure 4:
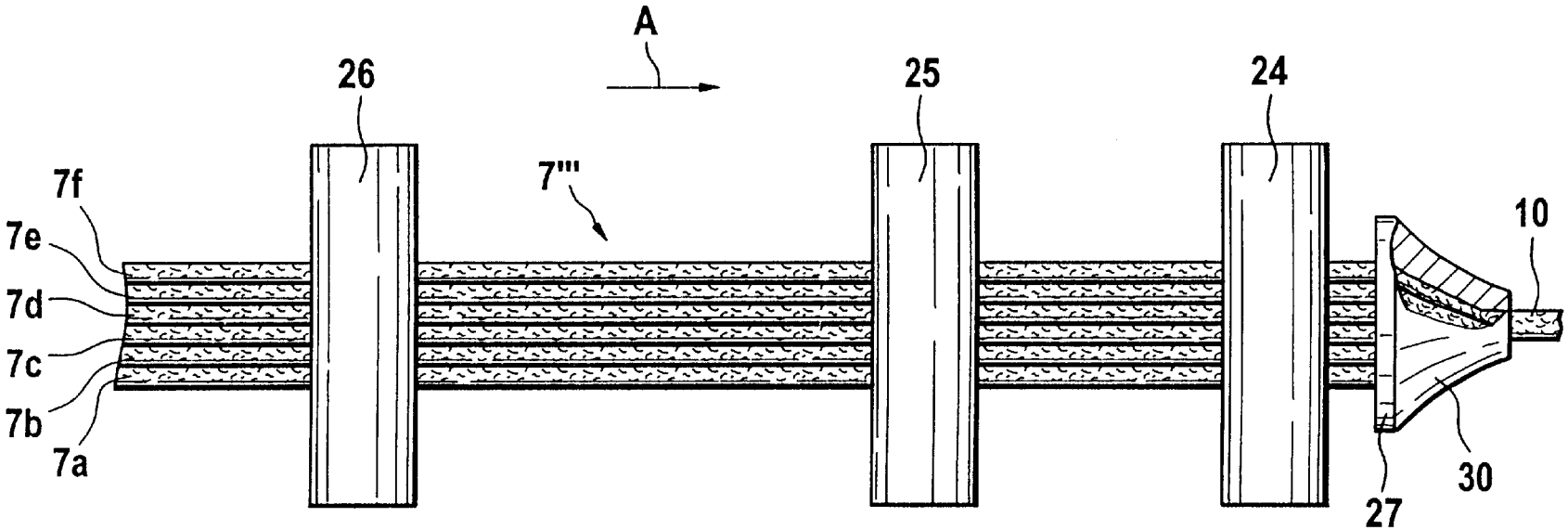
FIG. 4 is a top plan view of a draw unit of a draw frame illustrating linearly running slivers.

As seen in FIG. 4, the slivers 7*a*–7*f* run linearly and are oriented parallel to one another as they enter the draw unit 3 in the direction A. The slivers 7*a*–7*f* are situated closely side by side, they are in contact with one another and in this manner form a sliver bundle 7'". The slivers 7*a*–7*f* change their direction and converge only as they are drawn into the sliver guide 27. In the sliver trumpet 30 which immediately adjoins the sliver guide 27, the drawn output sliver 10 is formed from the sliver bundle; it exits the sliver trumpet 30 and is deposited into the coiler can 11.

Figure 5:
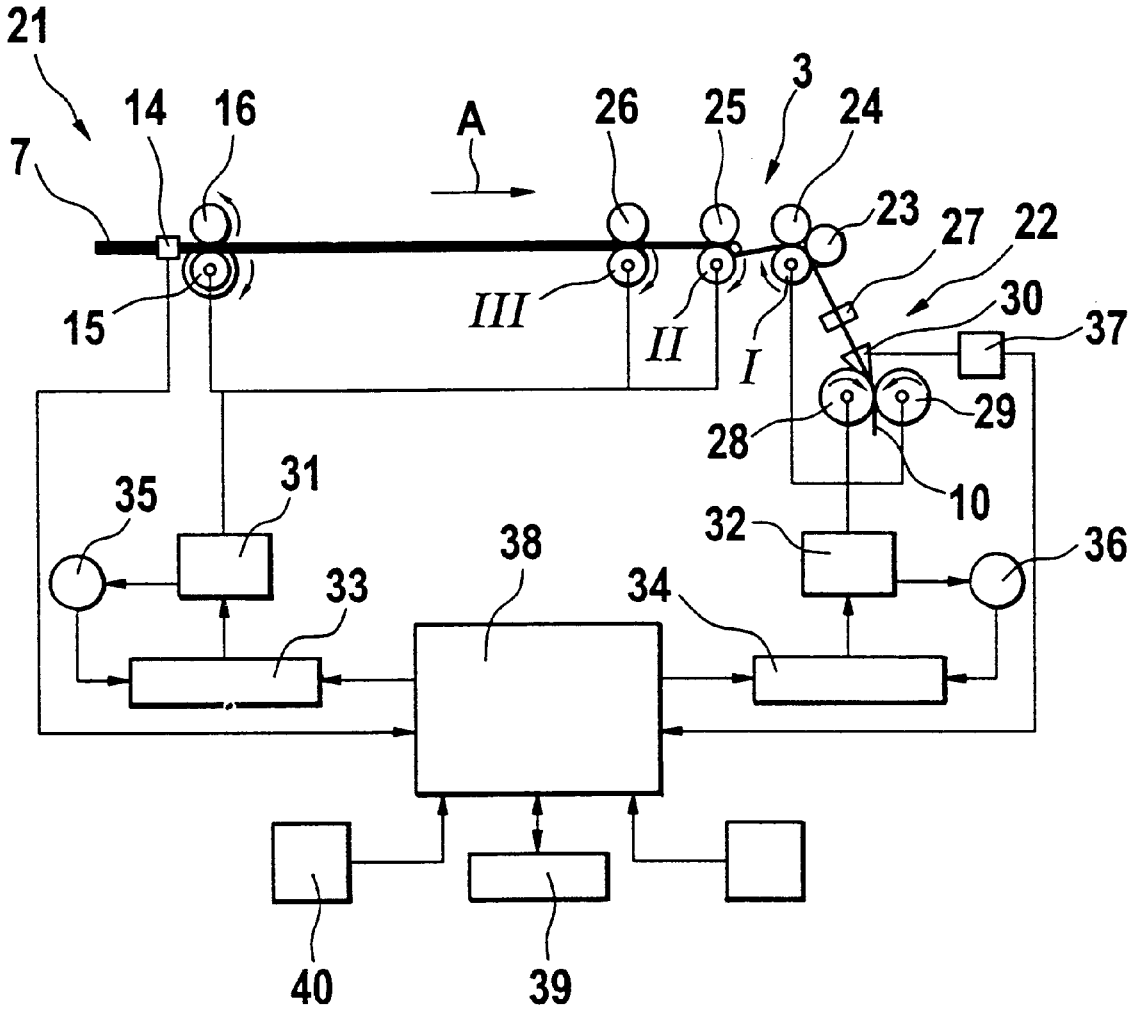
FIG. 5 is a block diagram with a schematic side elevational view of the draw unit, illustrating the electronic control and regulating device for the draw frame.

As shown in FIG. 5, the draw unit 3 has a draw unit inlet 21 and a draw unit outlet 22. The draw unit is of the 4-over-3 type, that is, it has three lower rolls (a lower output roll I, a lower mid roll II and a lower input roll III) as well as four upper rolls 23, 24, 25 and 26. In the draw unit 3 a drawing of the sliver bundle 7 formed of the plurality of slivers 7*a*–7*f* occurs. The drawing of the slivers is composed of a preliminary drawing and a principal drawing. The roll pairs 26/III and 25/III define the preliminary drawing field whereas the roll pair 25/II and the roll assembly 23, 24/I define the principal drawing field. The drawn slivers are admitted at the draw unit outlet 22 into a sliver guide 27 and are, by means of delivery rolls 28, 29 pulled through a sliver trumpet 30 in which the sliver bundle is combined into a sliver 10 which is subsequently deposited in a coiler can 11.

The rollers 15, 16, the lower input roll III and the lower mid roll II which may be mechanically coupled to one another, for example, by a t oothed belt, are driven by a regulating motor 31 to which a desired rpm value is applied. The associated upper rolls 26 and 25 are idlers and run with the respective lower rolls by frictional contact therewith. The regulating motor 31 and a principal motor 32 each have a respective regulator 33 and 34. The rpm regulation is effected by means of a closed regulating circuit. The regulating motor 31 is associated with a tachogenerator 35 and the principal motor 32 is associated with a tachogenerator 36. At the draw unit inlet 21 there is measured a magnitude proportional to the fiber mass, for example, the cross section (thickness) of the slivers by means of the sensor system 14. At the draw unit outlet 22 the cross section of the exiting sliver 10 is measured by an outlet measuring organ 37.

A central computer unit 38 (control and regulating device) such as a microcomputer with microprocessor, applies a setting of the desired rpm for the regulating motor 37 to the regulator 33. The measuring values of the measuring assembly 14 are, during the drawing operation, applied to the unit 38. From the measuring values of the measuring assembly 14 and from the desired value for the cross section of the output sliver 10 the setting value for the regulating motor 31 is determined in the central unit 38. The measuring values of the outlet measuring assembly 37 serve for monitoring the properties of the outputted sliver 10. With the aid of such a regulating system, fluctuations in the cross section of the inputted sliver 7 may be compensated for by a corresponding regulation of the preliminary drawing whereby a leveling of the sliver 10 is achieved. 39 designates an input device and 40 designates schematically the driving device for the supply rolls 8.

While the invention was described in connection with a regulated draw frame, it is to be understood that the invention may find application in non-regulated draw frames as well.

It will be understood that the above description of the present invention is susceptible to various modifications, changes and adaptations, and the same are intended to be comprehended within the meaning and range of equivalents of the appended claims.

What is claimed is:

1. A draw frame for drawing a plurality of simultaneously running inputted slivers and for combining the drawn silvers into a single outputted sliver, comprising (a) a draw unit having an inlet, an outlet and a roll assembly between said inlet and said outlet for drawing the inputted slivers;

(b) a creel for accommodating storage means containing a plurality of slivers and for advancing simultaneously the plurality of slivers to said draw unit;

(c) a sliver guide and a sliver trumpet arranged downstream of said outlet, as viewed in a direction of sliver run, for combining the plurality of drawn slivers into the output sliver; and (d) guiding means for orienting the running inputted slivers to run linearly and substantially parallel to one another, as viewed in a vertical direction, from said creel at least to said outlet of said draw unit.

2. The draw frame as defined in claim 1, wherein said guiding means includes means for orienting the running inputted slivers to run linearly and parallel to one another, as viewed in a vertical direction, from said creel to said sliver guide.

3. The draw frame as defined in claim 1, wherein said guiding means comprises a sliver deflecting arrangement mounted on said creel for changing a running direction of each sliver from an upward orientation to a generally horizontal orientation.

4. The draw frame as defined in claim 3, wherein said sliver deflecting arrangement comprises a plurality of sliver deflecting members spaced from one another in a direction oriented from said creel toward said draw unit.

5. The draw frame as defined in claim 3, wherein said sliver deflecting arrangement comprises annular eyelets through which respective running slivers pass.

6. The draw frame as defined in claim 3, further comprising sliver pulling and advancing roller pairs provided for each sliver and situated between said sliver deflecting arrangement and said roll assembly of said draw unit.

7. The draw frame as defined in claim 6, wherein each said sliver pulling and advancing roller pair comprises a groove roller and a tongue roller extending into one another for forming a space through which a respective running sliver passes.

8. The draw frame as defined in claim 3, wherein said sliver deflecting members are supply rolls; further comprising at least one upper roller cooperating with each said supply roll to define a nip therewith, between which a respective sliver passes.

9. The draw frame as defined in claim 8, further comprising springs for pressing each said upper roller against a respective said supply roll.

10. The draw frame as defined in claim 8, wherein said sliver deflecting members are supply rolls; further comprising drive means for rotating said supply rolls.

11. The draw frame as defined in claim 1, further comprising a sensor assembly disposed between said creel and said roll assemblies for measuring a thickness separately for each running sliver.

12. The draw frame as defined in claim 11, wherein said sensor assembly comprises a plurality of sensor fingers positioned to contact respective running slivers for mechanically detecting thickness variations thereof.

13. The draw frame as defined in claim 12, wherein said sensor fingers are spring-loaded for exerting a resilient force on the running slivers.

14. The draw frame as defined in claim 12, wherein said sensor assembly comprises transducers for converting excursions of said sensor fingers to respective electric signals.

15. The draw frame as defined in claim 14, further comprising means for adding said electric signals.

* * * * *